US005857542A

United States Patent [19]

Mason

[11] Patent Number: 5,857,542

[45] Date of Patent: Jan. 12, 1999

[54] REMOVABLE STEP MEMBER AND METHOD

[76] Inventor: Robert J. Mason, 1503 S. Madison, Hugoton, Kans. 67951

[21] Appl. No.: 974,900

[22] Filed: Nov. 20, 1997

[51] Int. Cl.[6] ..... E06C 7/00

[52] U.S. Cl. ..... 182/92; 248/297.51

[58] Field of Search ..... 182/90–92, 223; 248/297.51

[56] References Cited

U.S. PATENT DOCUMENTS

| | | | |
|---|---|---|---|
| 730,580 | 6/1903 | Stanford . | |
| 770,205 | 9/1904 | Warren | 182/92 |
| 1,206,203 | 11/1916 | Brockway . | |
| 2,941,617 | 6/1960 | Stiffler | 182/223 |
| 3,464,518 | 9/1969 | Stelovich | 182/223 |
| 3,817,351 | 6/1974 | Mikkleson | 182/196 |
| 5,033,583 | 7/1991 | Candelaria | 182/92 |
| 5,244,058 | 9/1993 | Carlson | 182/228.1 |

FOREIGN PATENT DOCUMENTS

| | | | |
|---|---|---|---|
| 2826235 | 12/1979 | Germany | 182/90 |

*Primary Examiner*—Alvin Chin-Shue

*Attorney, Agent, or Firm*—Townsend and Townsend and Crew

[57] ABSTRACT

A step member for being removably secured to a fence post to facilitate a person climbing over a fence. The step member includes a generally integral structure having a protruding lug, including a lug recess. The integral structure of the step member further includes a structural recess wherein a portion of a fence post may removably lodge. The fence post includes a wire stop for being removably lodged within the lug recess. Instead of a generally integral structure, the step member may include a generally hollow step body wherein a step extender slidably lodges. A catch or latch member is secured to the hollow body for positioning the step extender in an affixed relationship with respect to the hollow body. A method for climbing over a fence including removably securing a step member to a wire stop of a fence post, such that the step member may receive the foot of a person who wishes to climb over a fence.

20 Claims, 15 Drawing Sheets

REMOVABLE STEP MEMBER AND METHOD

BACKGROUND OF THE INVENTION

1. Field of the Invention

This invention is related to a detachable supporting step. More particularly, the present invention provides for a detachable or removable supporting step member and method for stepping or climbing over a fence. The detachable step of the present invention is of the type which is capable of being removably secured to a post, more particularly to a post supporting wires (i.e. barb wire) in the form of a fence.

2. Description of the Prior Art

A patentability investigation was conducted and the following U.S. Patents were discovered: U.S. Pat. No. Design 42,598 to White entitled "Step For Poles"; U.S. Pat. No. 2,086,280 to Matter entitled "Support"; U.S. Pat. No. 3,008,536 to Linabery, Sr. entitled "Detachable Supporting Step"; U.S. Pat. No. 3,259,209 to Brown entitled "Ladder"; U.S. Pat. No. 3,561,563 to Harsh entitled "Portable Post Step"; U.S. Pat. No. 4,754,841 to Koffski entitled "Portable Step"; and U.S. Pat. No. 5,407,025 to Nickel entitled "Gripping Device for Timber".

U.S. Pat. No. 2,086,280 to Matter teaches a support member having a horizontal supporting member with a depending brace member integrally bound thereto and generally at a right angle thereto. An upwardly projecting stop is secured to the horizontal step. A widened flange is integrally bound to the step and includes a generally U-shaped opening (see FIG. 4) wherein a stilt may be lodged.

U.S. Pat. No. Design 42,598 to White is an ornamental design for a step for poles and includes a generally rectangular opening (see FIG. 1) wherein a pole may slideably lodge. The rectangular opening is defined by a side wall with a plurality of teeth which is to engage a pole.

U.S. Pat. No. 3,008,536 to Linabary Sr. discloses a detachable support step having a body member including a top flange having a horizontal flange secured at one end thereof and a clamping element secured at another end thereof. A second clamping element is secured to a lower surface of the flange of a vertical sign post, or the like is slideably disposed between the clamping element and the second clamping element while being flushed against the vertical side flange and the horizontal top flange.

U.S. Pat. No. 3,259,209 to Brown discloses a ladder including a detachable step. The step includes U-bend hanger, a shank integrally bound to the U-bend hanger, and a cross bar bound to an end of the shank. Opposed ends of the cross bar include a pair of arms. A stud is integrally bound to the shank and protrudes generally normal therefrom.

U.S. Pat. No. 3,561,563 to Harsh discloses (see FIG. 2) a step formed with a notch opening. A post lodges within the notch opening.

U.S. Pat. No. 4,754,841 to Koffski discloses a step having an opening where through a post slideably passes.

U.S. Pat. No. 5,407,025 to Nickel discloses a gripping device for timber. The grouping device is formed from a single length of steel rod having a generally U-shaped opening wherein timber lodges. One side of the U-shaped opening is formed with a wall, having bound thereto a toothed angle member with a series of teeth which engage the timber.

None of the foregoing prior art U.S. patents teach the particular removable or detachable supporting step member and method of the present invention.

SUMMARY OF THE INVENTION

The present invention accomplishes its desired objects by broadly providing an apparatus for stepping or climbing over a fence, comprising:

a. a stepping means for receiving a user's foot;

b. a step recess means disposed in the stepping means for removably engaging a post;

c. a lug means integrally extending from the stepping means for supporting the stepping means against a post; and d. a lug recess means disposed in the lug means for removably attaching to a post.

The present invention more specifically provides a stepping member that is removably attached to a post. The post comprises at least one wire which constitutes a portion of a fence. The post, moreover, comprises a plurality of post knobs capable of removably receiving the step member. The step member is geometrically defined by a platform comprising a base, a top opposing the base, and walls connecting the base to the top. The step member comprises a recess for removably engaging the post. A lug provides support to the step member when pressure is applied to the step member in a downwardly direction. A lug recess is disposed in the lug for detachably receiving the post knobs.

In an alternative embodiment, the present invention accomplishes its objects by broadly providing, in combination with a post, an apparatus for stepping or climbing over a fence, comprising:

a. a post having at least one wire secured thereto (e.g. a barb wired fence); and b. a step member for detachably connecting to the post, wherein the step member has a structure defining a cavity, a step recess communicating with the cavity, and a knob recess also communicating with the cavity.

In this embodiment, the step member, although harboring a similar platform shape as the above embodiment, comprises different elements. First, it includes a cavity on the step member for receiving the post. Second, a step recess communicates with the cavity and removably receives and engages the post. Third, a knob recess is disposed in the structure of the apparatus and communicates with the cavity for detachably receiving the post knobs.

In another embodiment, the present invention accomplishes its objects by broadly providing, in combination with a post, an apparatus for stepping or climbing over a fence comprising:

a. a hollow casing means for detachably attaching to a post; and b. an arm means, slidably engaged to the hollow casing means, for receiving a user's foot.

This embodiment more specifically provides a stepping member that comprises two major components. The first component is a hollow case having a structure including a step recess, a lug, and a lug recess. The step recess is for removably receiving the post; the lug is for providing support to the hollow case when pressure is being applied in a downwardly direction by a user's foot; and the lug recess, disposed in the lug, is for detachably receiving the post knobs. The hollow case additionally has a case aperture and a catch assembly secured thereto for releasably locking the arm means or slidable extender through the case aperture.

The catch assembly may be a pin member or a spring pin assembly. The second component is a slidable extender capable of receiving a user's foot. The slidable extender comprises an arm recess for aligning with the step recess when the slidable extender is extended out of the hollow case. The arm recess, when aligned with the step recess, removably receives the post. The slidable arm extender additionally comprises at least a pair of pin recesses for being aligned with the case aperture and releasably receiving and engaging with the catch assembly.

The present invention also accomplishes its desired objectives by broadly providing a method for stepping or climbing over a fence, comprising the steps of:

a. providing a post having at least one wire secured thereto (e.g. a barb wired fence);

b. detachably securing a step assembly against the post of step (a);

c. placing a first foot on the step assembly;

d. swinging a second foot over the wires;

e. placing the second foot on the step assembly; and f. removing the first foot from the step assembly and swinging the first foot over at least one wire for stepping over a fence.

The step assembly in step (b) of the immediate above method may encompass any of the three different aforementioned embodiments.

It is therefore an object of the present invention to provide a step member which may be readily removably secured to a fence post in order for a person to climb over a fence.

It is another object of the present invention to provide a method for climbing over a fence, preferably a barbed wire fence.

These, together with the various ancillary objects and features which will become apparent to those skilled in the art as the following description proceeds, are attained by this novel step member and method, a preferred embodiment thereof shown with reference to the accompanying drawings, by way of example only, wherein:

DETAILED DESCRIPTION OF PREFERRED EMBODIMENTS OF THE INVENTION

Figure 1:
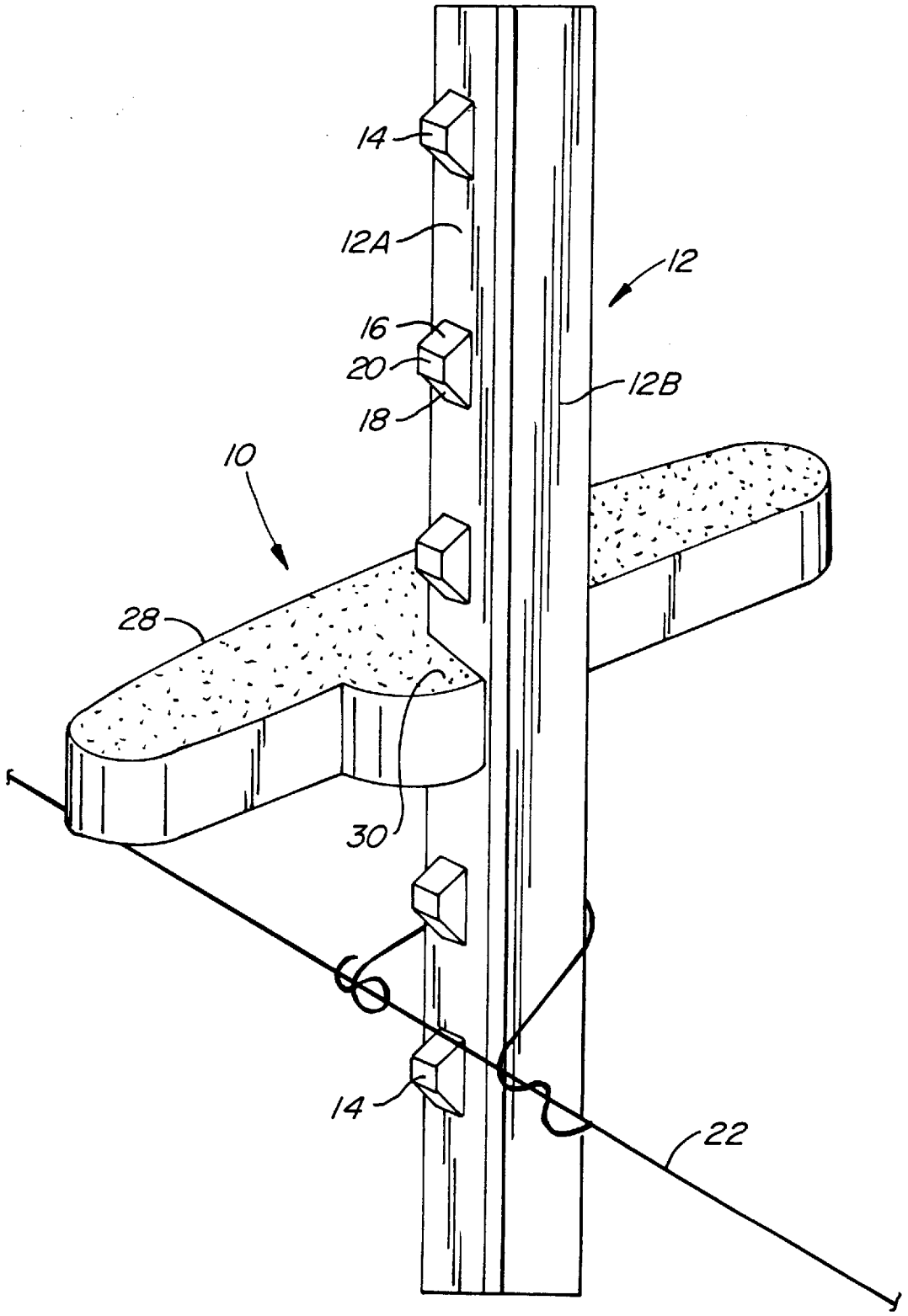
FIG. 1 is a perspective view of one embodiment of the stepping structure of the step member of the present invention releasably engaged to a post member having a plurality of post lugs or wire stops integrally bound thereto and including a wire secured thereto.
Figure 10A:
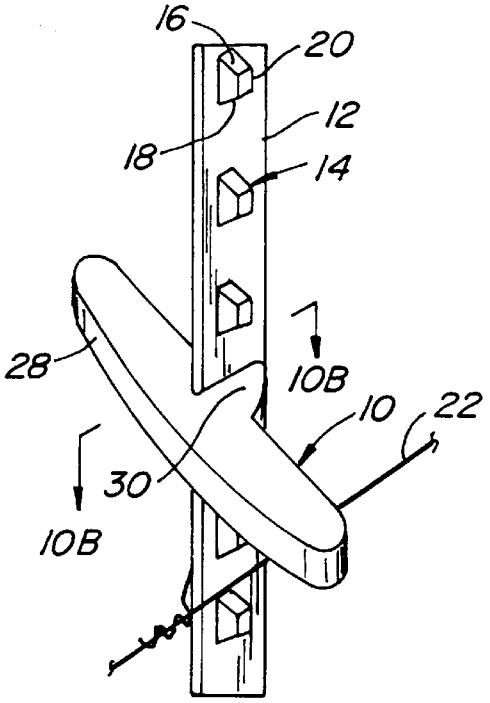
FIG. 10A is another perspective view of the embodiment of the invention depicted in FIG. 1.

Referring in detail now to the drawings wherein similar parts of the invention are identified by like reference numerals, and initially referring to FIGS. 1–10B for one preferred embodiment of the invention, there is seen a stepping structure or step member, generally illustrated as 10, removably or detachably secured to a post 12 (see FIGS. 1 and 10A). The post 12 is a conventional post having a plurality of post knobs or wire stops 14 integrally bound thereto. The post 12 is generally T-shaped in horizontal cross-section, having a structure consisting of a pair of wings 12A and 12B which are integrally bound to each other. The wire stops 14 are generally trapezoidally shaped in a side elevational view with a pair of inwardly sloping sides 16 and 18 terminating in an end surface 20 (see FIG. 1). The wire stop 14 are for preventing wires, such as wires 22 in FIGS. 1, 11, 18, and 33, from sliding downwardly. A plurality of posts 12 and wires 22 typically make up a fence, generally illustrated as 24 in FIG. 33. The step member 10 of the present invention may be manufactured of any suitable material, including steel, plastic, wood, etc.

Figure 2:
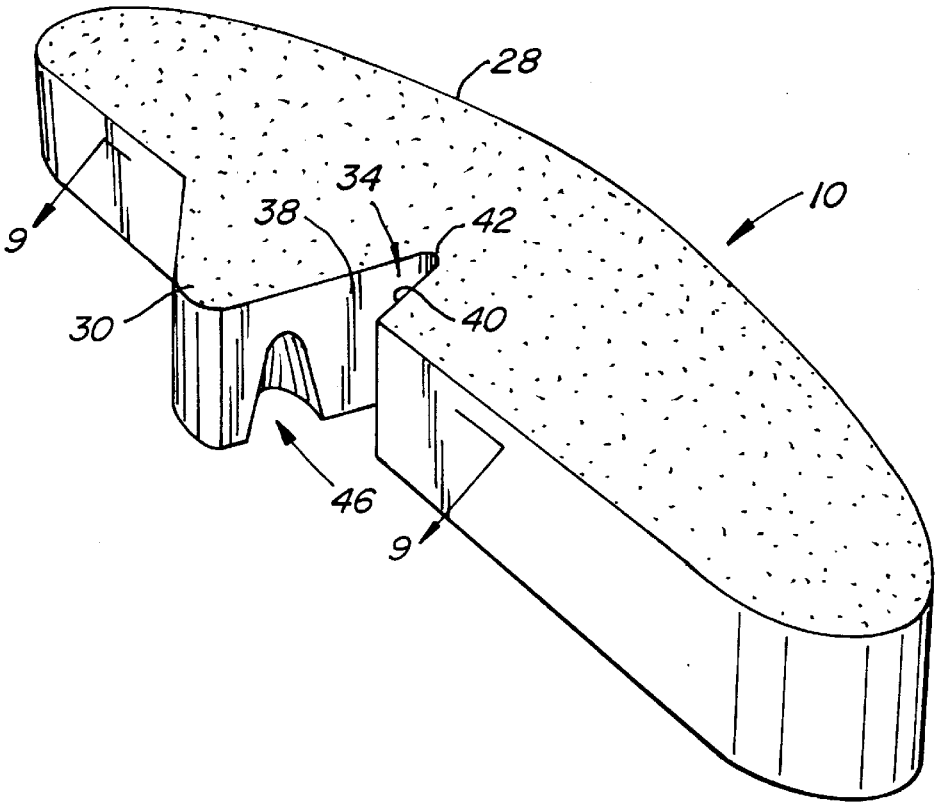
FIG. 2 is a perspective view of the step member of FIG. 1.
Figure 3:
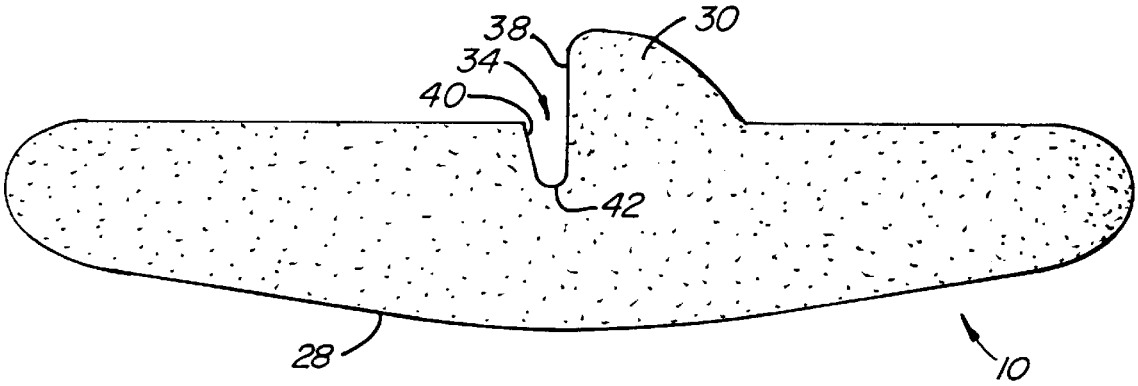
FIG. 3 is a top plan view of the step member of FIG. 2.
Figure 4:
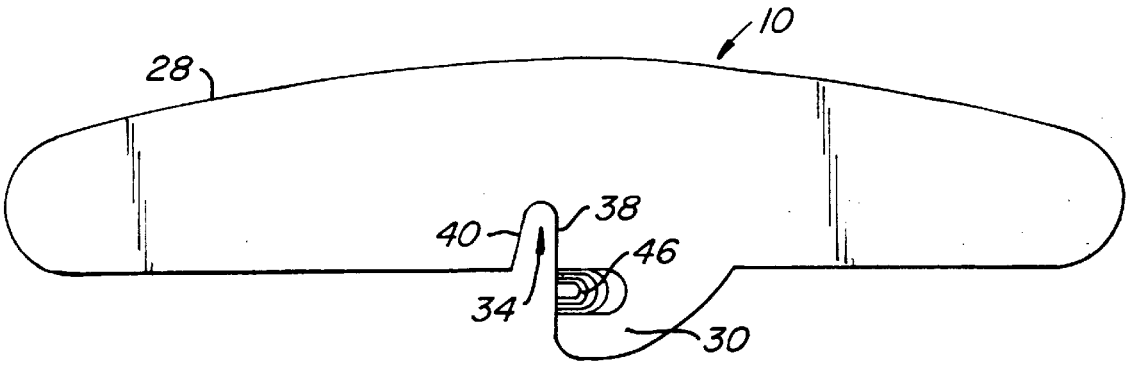
FIG. 4 is a bottom plan view of the step member of FIG. 2 illustrating a lug recess which is for engaging one of the post lugs or wire stops.
Figure 5:
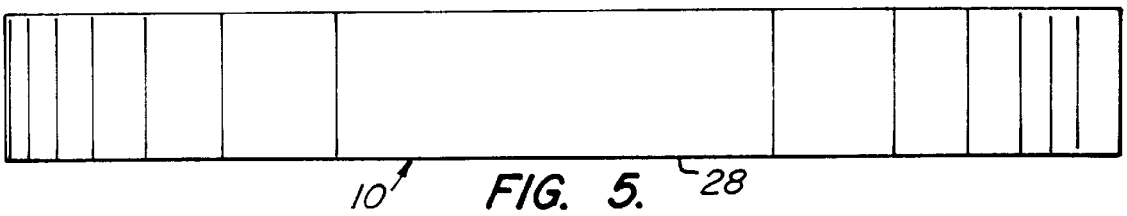
FIG. 5 is a front elevational view of the step member of FIG. 2.
Figure 6A:
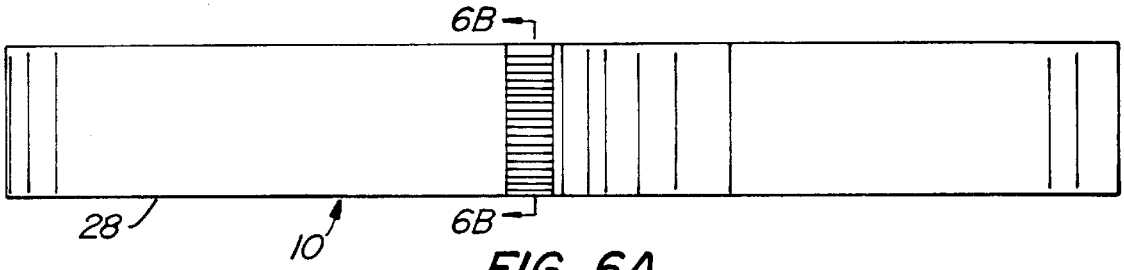
FIG. 6A is a rear elevational view of the step member of FIG. 2.
Figure 6B:
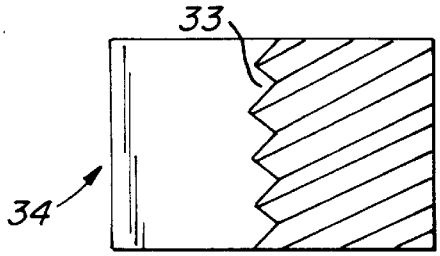
FIG. 6B is a vertical sectional view taken in direction of the arrows and along the plane of line 6B—6B in FIG. 6A.
Figure 7:
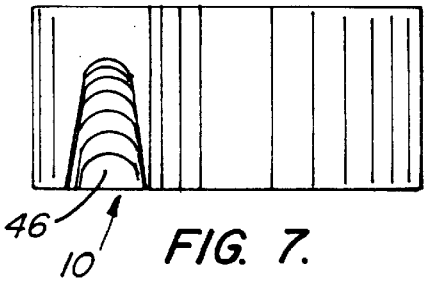
FIG. 7 is an end elevational view of the step member of FIG. 2.
Figure 8:
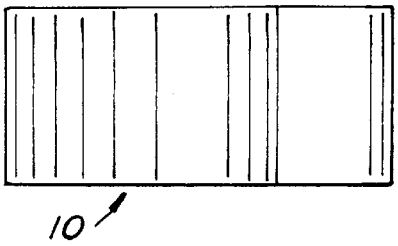
FIG. 8 is an end elevational view of the step member of FIG. 2, taken at an end which is opposed to the end shown in FIG. 7.
Figure 9:
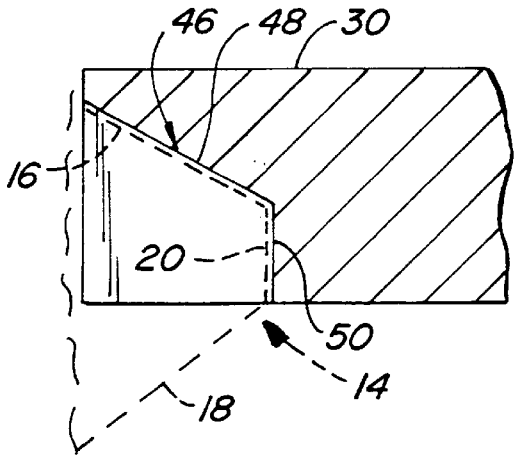
FIG. 9 is an enlarged vertical sectional view taken in direction of the arrows and along the plane of line 9—9 in FIG. 2.
Figure 10B:
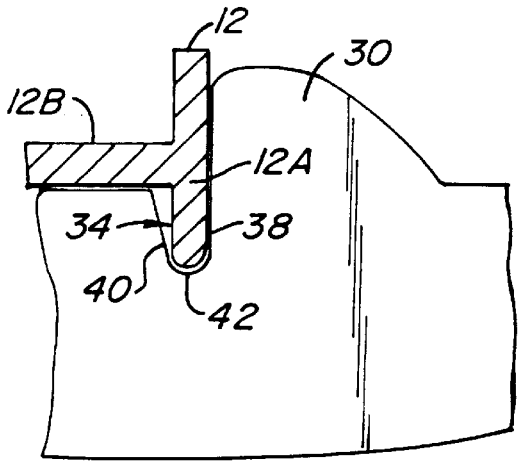
FIG. 10B is a horizontal sectional view taken in direction of the arrows and along the plane of line 10B—10B in FIG. 10A.
Figure 10C:
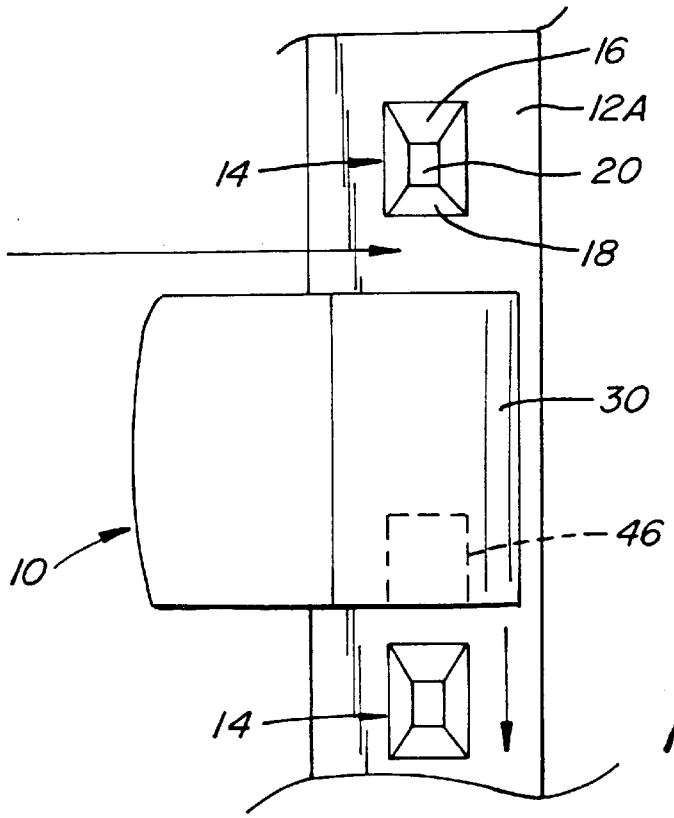
FIG. 10C demonstrates how a user commences to removably attach the step assembly to the post.
Figure 10D:
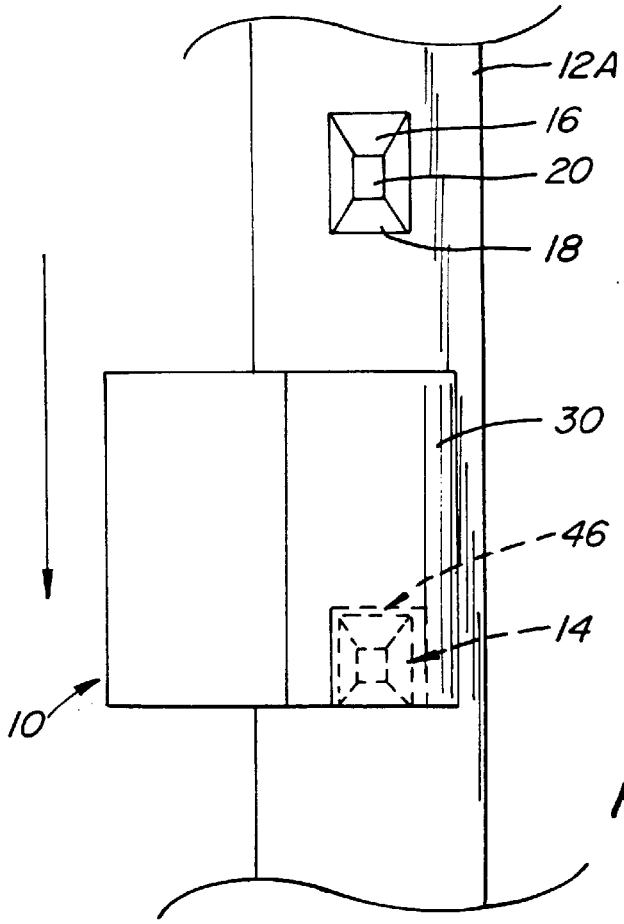
FIG. 10D depicts a method step, subsequent to the method step illustrated in FIG. 10C, demonstrating how a user further removably attaches the step assembly to the post.
Figure 11:
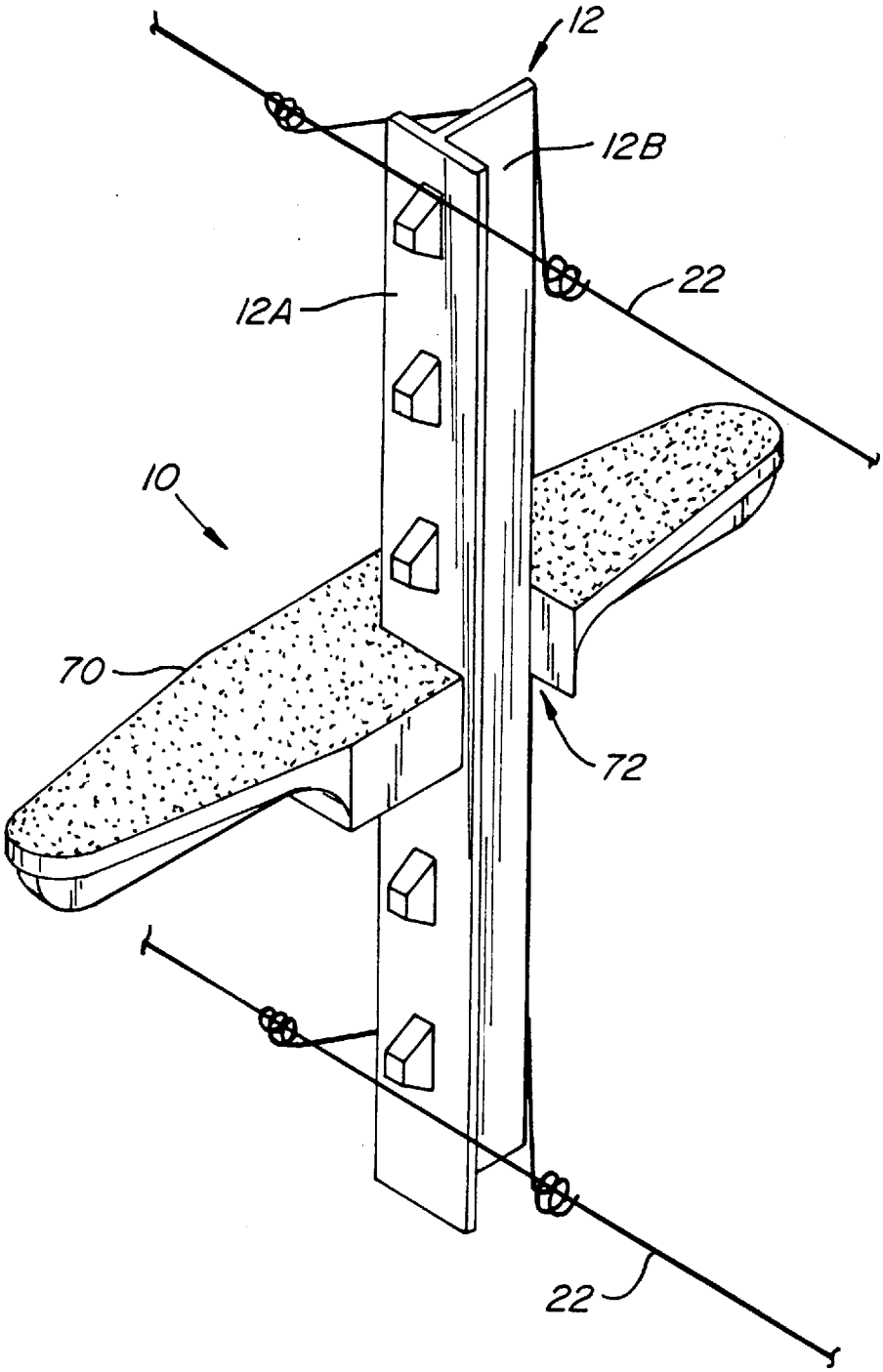
FIG. 11 is a perspective view of another embodiment of a stepping structure of the step member of the present invention releaseably engaged to a post member having a plurality of post lugs or wire stops integrally bound thereto and including a pair of wires secured thereto.

Continuing to refer to FIGS. 1–10B for a preferred embodiment of the step member 10 illustrated therein, there is seen the step member 10 comprising a generally integral structure 28 including an ear or lug 30 protruding therefrom and a recess 34 formed therein for receiving the wing member 12A of the post 12 (see FIG. 10B). The recess 34 is defined by opposed side walls 38 and 40 secured to an end wall 42. The side walls 38 and 40 and the end wall 42 may be structurally defined by teeth 33, a illustrated in FIG. 6B, to produce a higher coefficient of friction. As shown in FIG. 2, side wall 38 extends outwardly to form part of the lug 30. Side wall 38 is interrupted by a lug recess 46 (see FIGS. 2 and 9). Lug recess 46 includes a sloping top 48 and a back 50 for respectively mating with and contacting sloping side 16 and end surface 20 (see FIG. 9). It is to be understood that the spirit and scope of the present invention would include a lug recess 46 without a sloping top, that slopes, such as a top that is generally perpendicular to the back 50 and generally parallel to the ground when the step member 10 is secured to the post 12. To secure this embodiment of the step member 10 to the post 12 as best shown in FIGS. 10C and 10D, the wing member 12A is passed into recess 34 simultaneously with the lug 30 being passed between any two contiguous post knobs or wire stops 14. When the lowermost of the two contiguous wire stops 14 is aligned or registered with the lug recess 46, the integral structure 28 of the step member 10 is moved and slid downwardly along the wing member 12A to cause the lowermost wire stop 14 to pass into the lug recess 46 and to respectively flush the sloping side 16 and end surface 20 of the wire stop 14 against the sloping top 48 and back 50 of the lug recess 46. For releasing the wire stop 14 from within the lug recess 46, the procedure is reversed.

Figure 12:
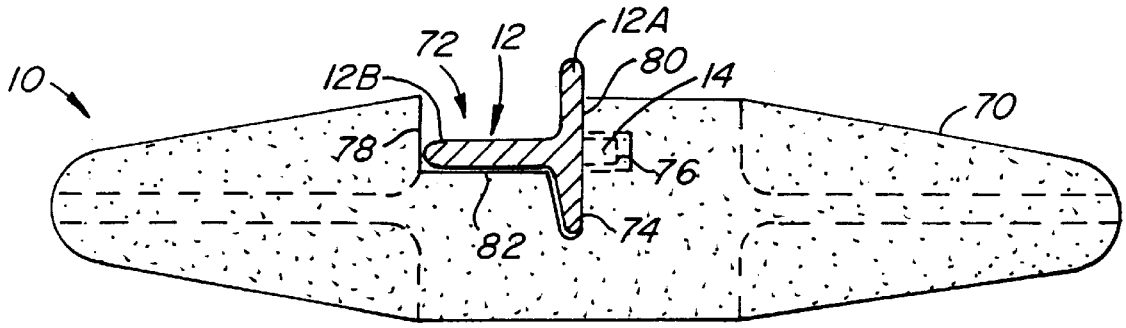
FIG. 12 is a top plan view of the step member of FIG. 11 with the post received in the step cavity and the wire stop engaged the recess.
Figure 13:
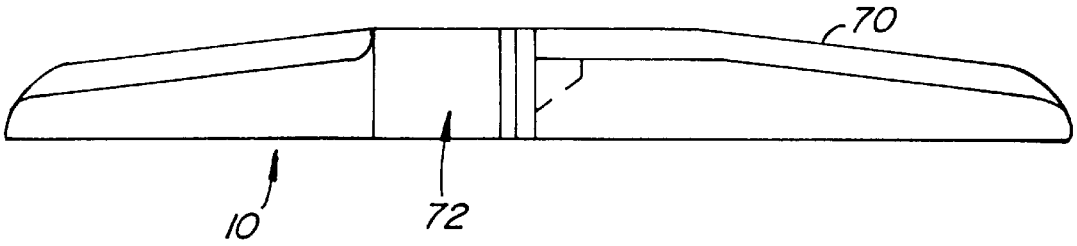
FIG. 13 is a rear elevational view of the step member of FIG. 11.
Figure 14:
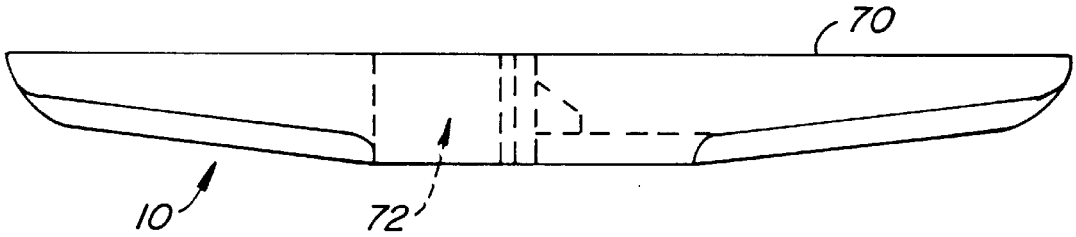
FIG. 14 is a front elevational view of the step member of FIG. 11.
Figure 15:
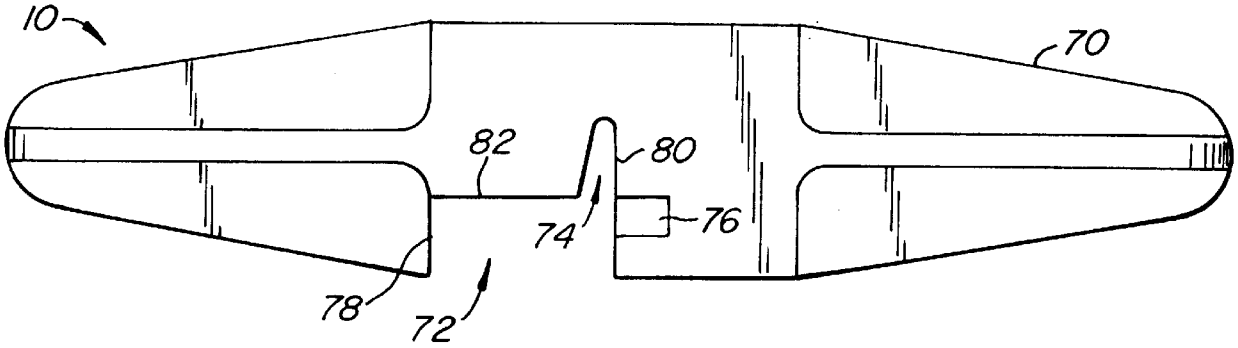
FIG. 15 is a bottom plan view of the step member of FIG. 11.
Figure 16:
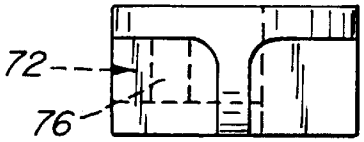
FIG. 16 is an end elevational view of the step member of FIG. 11.
Figure 17:
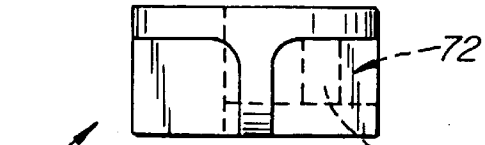
FIG. 17 is an end elevational view of the step member of FIG. 11, taken at an end which is opposed to the end shown in FIG. 16.
Figure 18:
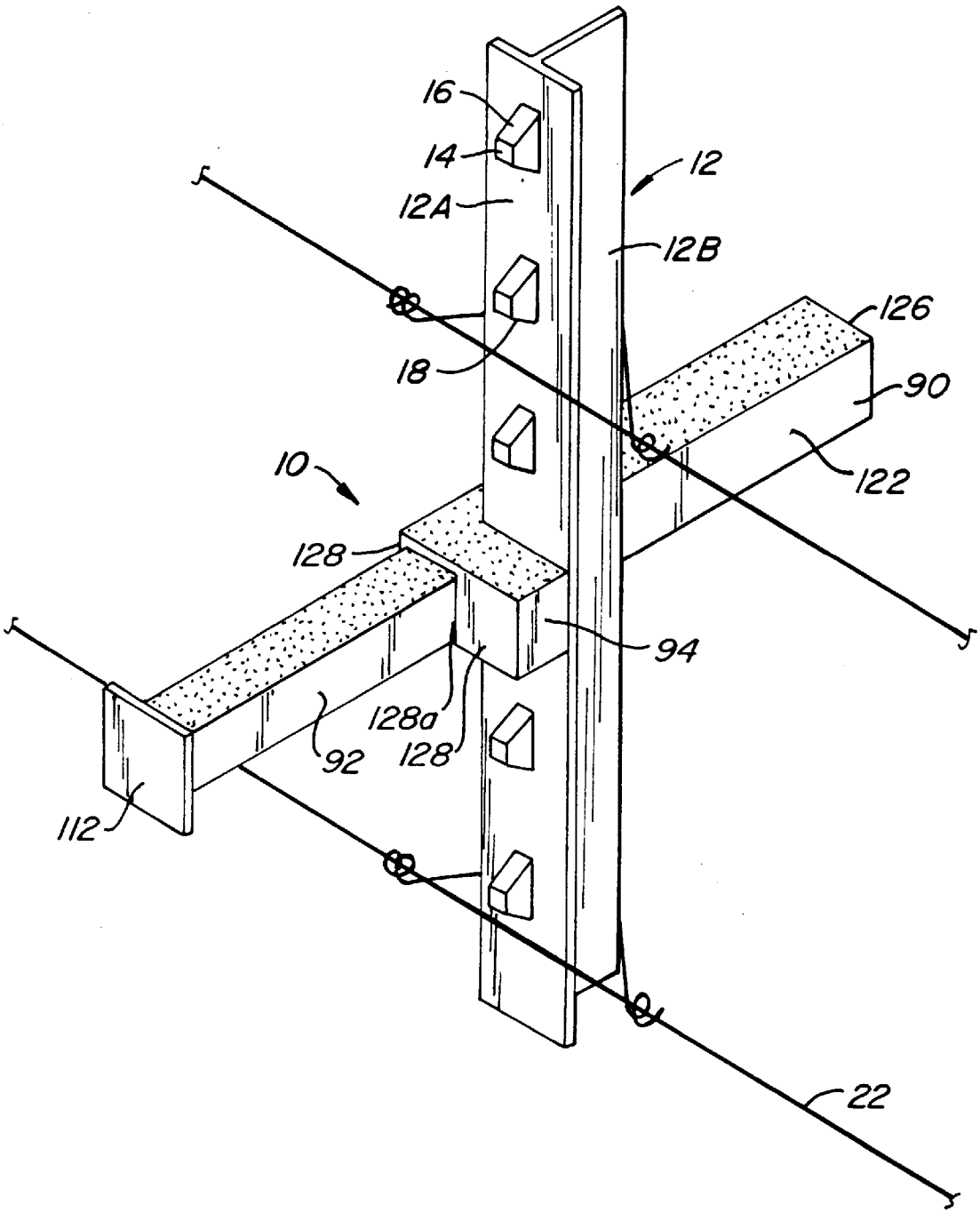
FIG. 18 is a perspective view of another embodiment of the stepping structure of the step member of the present invention releaseably engaged to a post member having a plurality of post lugs or wire stops integrally bound thereto and including a pair of wires secured thereto.

Referring now to FIGS. 11–17 for another preferred embodiment of the step member 10, there is seen the step member 10 comprising a generally integral structure 70 including a cavity 72 indented therein and a step recess 74 and knob recess 76 also formed therein. The cavity 72 is for receiving the wing member 12B and the step recess 74 is for receiving the wing member 12A of the post 12. The cavity 72 is defined by opposed side walls 78 and 80 secured to an adjoining wall 82. As shown in FIG. 12, side wall 80 is integrally bound to form part of step recess 74. Side wall 80 is interrupted by the knob recess 76. To secure this embodiment of the step member 10 to the post 12, the wing member 12A is passed into step recess 74 simultaneously with the cavity 72 being passed between any two contiguous post knobs or wire stops 14. When the lowermost of the two contiguous wire stops 14 is aligned or registered with the knob recess 76, the integral structure 70 of the step member 10 is moved and slid downwardly along the wing member 12A to cause the lowermost wire stop 14 to pass into knob recess 76. For releasing the wire stop 14 from within the knob recess 76, the procedure is reversed.

Figure 19:
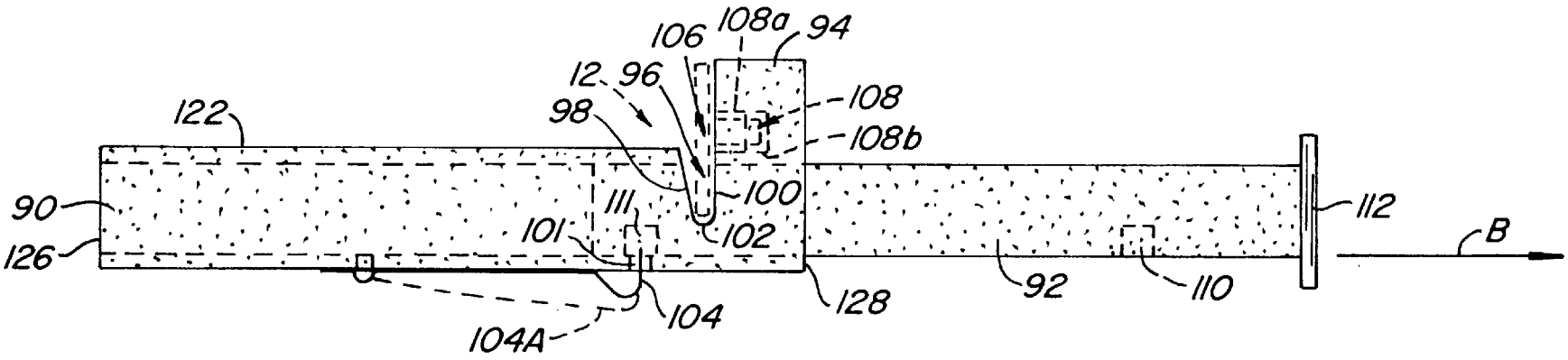
FIG. 19 is a top plan view of the step member of FIG. 18 with the slidable extender or sliding member having been slid out of the hollow body of the step member and with the catch or engaging means passing through an opening in the hollow body of the step member and protruding into a rear or back recess of the slidable extender.
Figure 20:
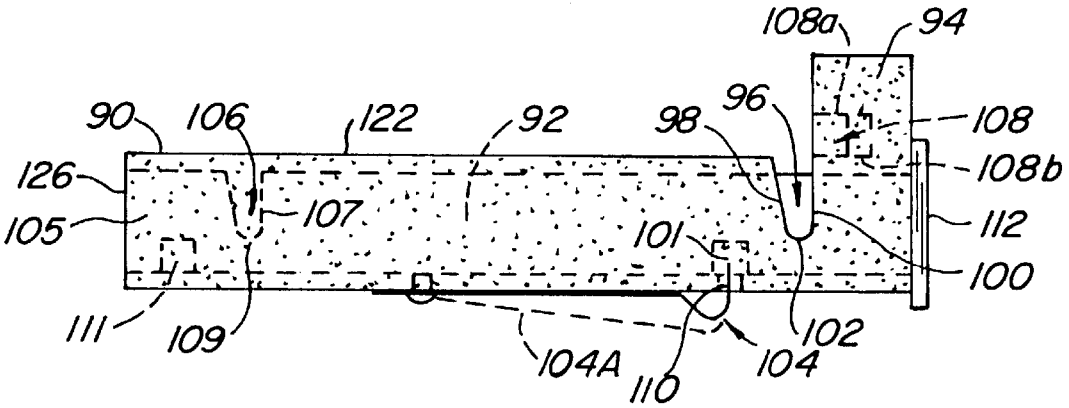
FIG. 20 is a top plan view of the step member of FIG. 18 in a closed or "carry" position with the slidable extender being slid entirely into the hollow body of the step member and including the catch or engaging means passing through a recess in the hollow body and projecting into a front recess of the extender to lock the slidable extender within the hollow body of the step member.
Figure 21:
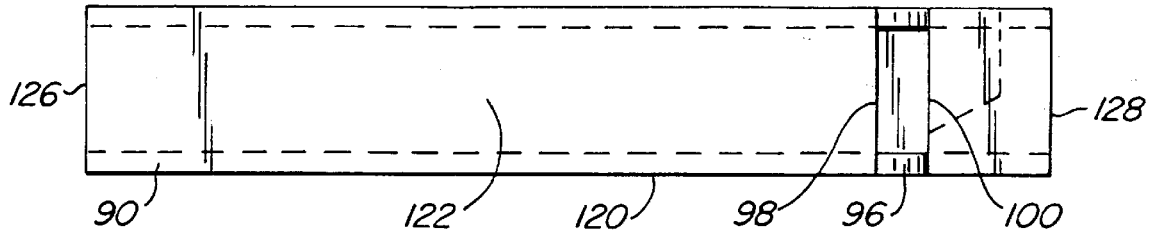
FIG. 21 is a rear elevational view of the hollow body of the step member of FIG. 18.
Figure 22:
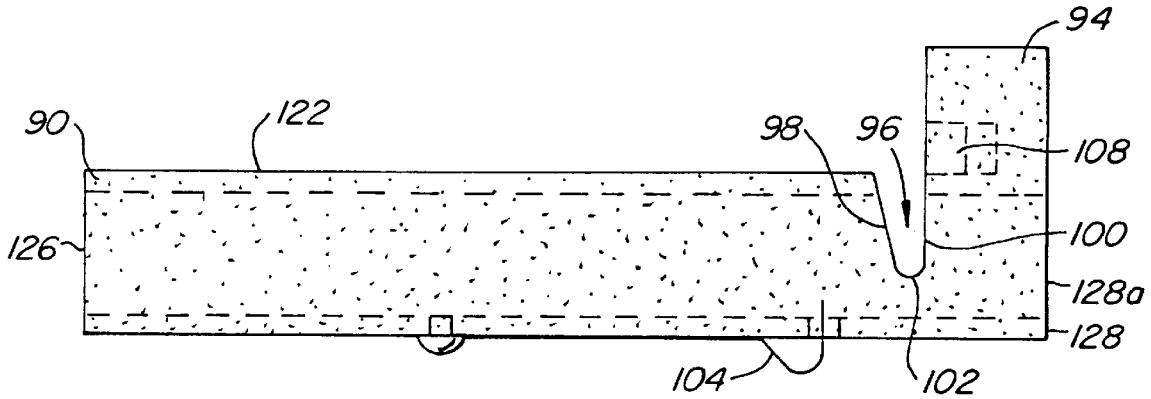
FIG. 22 is a top plan view of the hollow body of the step member of FIG. 18.
Figure 23:
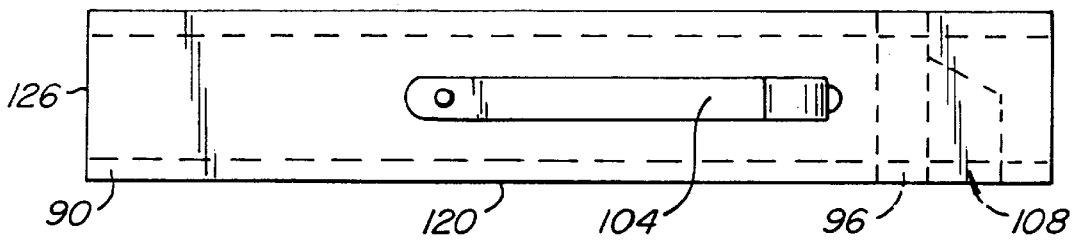
FIG. 23 is a front elevational view of the hollow body of the step member of FIG. 18.
Figure 24:
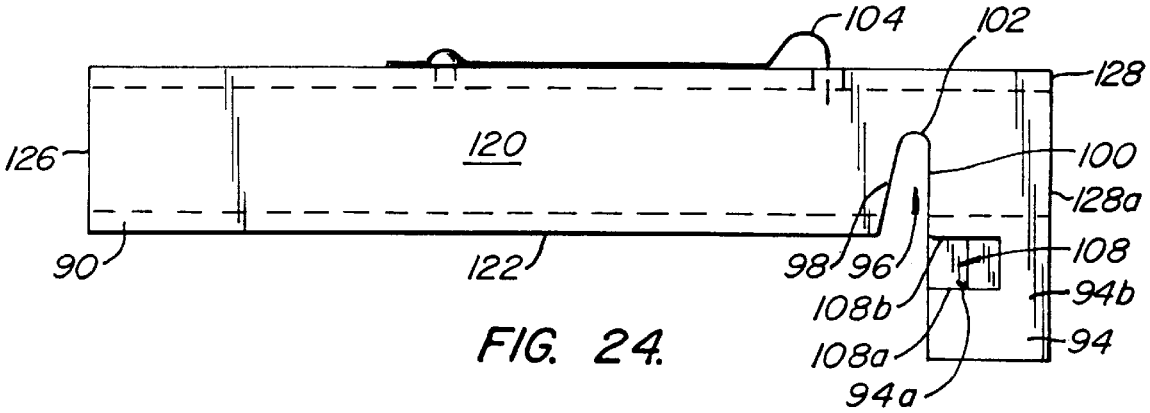
FIG. 24 is a bottom plan view of the hollow body of the step member of FIG. 18.
Figure 25:
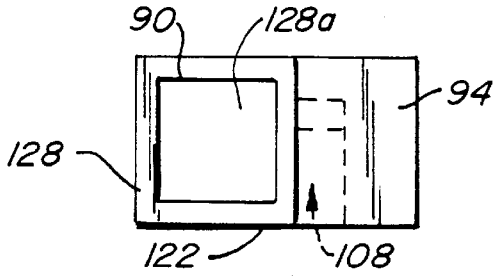
FIG. 25 is an end elevational view of the hollow body of the step member of FIG. 18.
Figure 26:
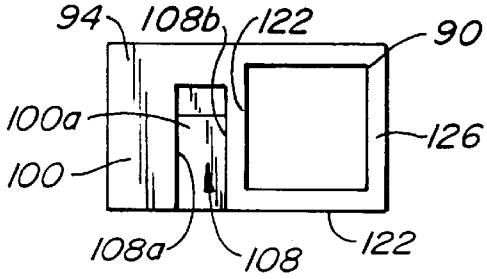
FIG. 26 is an end elevational view of the hollow body of the step member of FIG. 18, taken at an end which is opposed to the end shown in FIG. 25.
Figure 27:
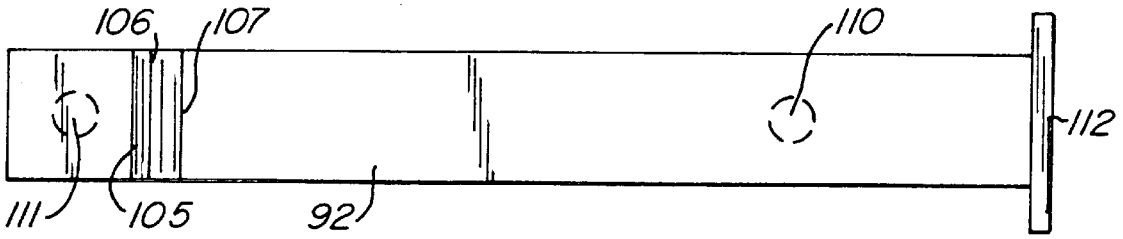
FIG. 27 is a rear elevational view of the slidable extender or sliding member of the step member of FIG. 18.
Figure 28:
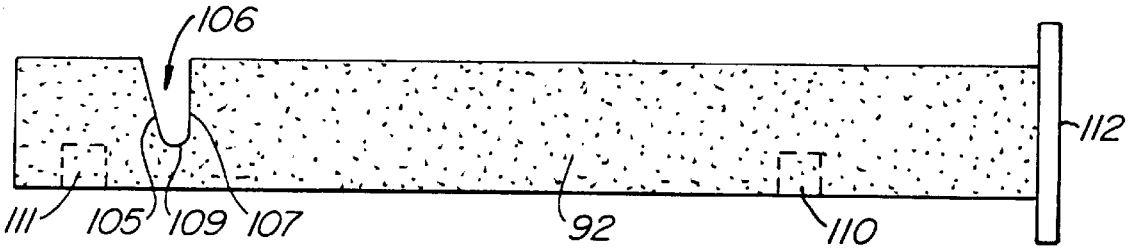
FIG. 28 is a top plan view of the slidable extender or sliding member of the step member of FIG. 18.
Figure 29:
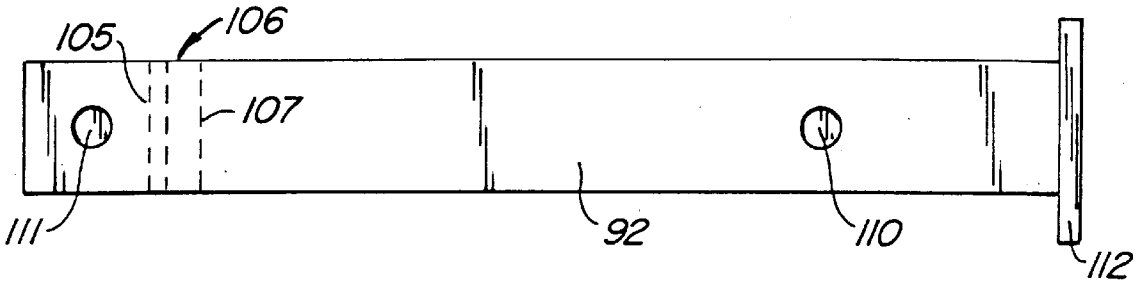
FIG. 29 is a front elevational view of the slidable extender or sliding member of the step member of FIG. 18.
Figure 30:
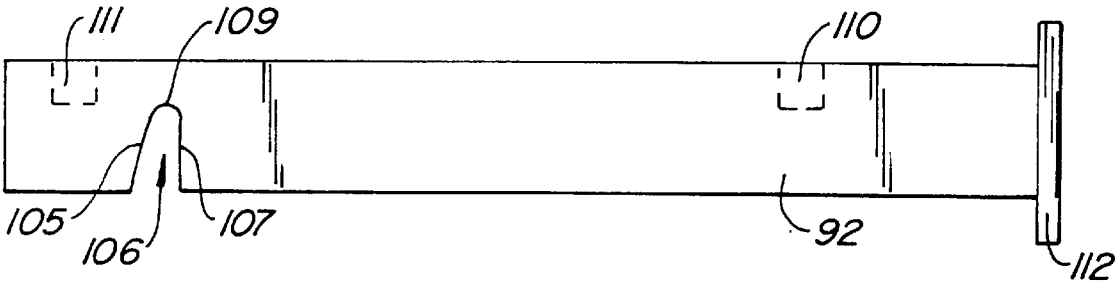
FIG. 30 is a bottom plan view of the slidable extender or sliding member of the step member of FIG. 18.
Figure 31:
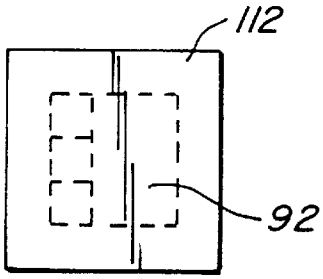
FIG. 31 is an end elevational view of the slidable extender or sliding member of the step member of FIG. 18.
Figure 32:
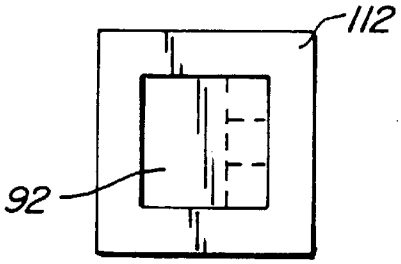
FIG. 32 is an end elevational view of the slidable extender or sliding member of the step member of FIG. 18, taken at an end which is opposed to the end depicted in FIG. 31.

Referring now to FIGS. 18–32 for yet another preferred embodiment of the step member 10, there is seen the step member 10 comprising a hollow case 90 including a slidable extender or sliding member 92 slidably disposed therein. An ear or lug 94 is integrally bound to and protrudes from the hollow case 90. A recess 96 is formed in the hollow case 90 for receiving the wing member 12A of the post 12. The case recess 96 is defined by opposed side walls 98 and 100 secured to an end wall 102. As shown in FIG. 19, side wall 100 extends outwardly to form part of the lug 94. Side wall 100 is interrupted by a lug recess 108. The hollow case 90 additionally comprises a catch assembly 104 for releasably locking the slidable extender 92. The catch assembly 104 may be a pin member or a spring pin assembly, or any other latching assembly that is capable of providing the function of the catch assembly 104. At least a portion of the catch assembly 104 is removably inserted in a case aperture 101 in the hollow case 90. The slidable extender 92 comprises an arm recess 106 for aligning with the case recess 96 when the slidable extender is drawn out of the hollow case 90 (see FIG. 19). The arm recess 106 is defined by opposed side walls 105 and 107 secured to an end wall 109. The arm recess 106, in conjunction with the case recess 96, receives the wing member 12A. The slidable extender 92 additionally includes a pair of pin recesses 110 and 111 for releasably engaging the catch assembly 104 for locking the slidable extender 92 to the hollow case 90. A flange 112 is coupled to the slidable extender 92 to facilitate the operation of the slidable extender 92 for a user. To secure this embodiment of the step member 10 to the post 12, the catch assembly 104 is moved into the dotted line representation, as illustrated by 104A in FIG. 20, to disengage the catch assembly 104 from the pin recess 110. The slidable extender 92 may then be drawn out of the hollow case 90 in the direction of arrow B (see FIG. 19). More specifically and as best shown in FIG. 19, when the catch assembly 104 is moved out of pin recess 110 and out of the case aperture 101 and into the dotted line representation 104A of FIG. 19, the slidable extender 92 may be moved out of the hollow case 90. When the slidable extender 92 is extended from the hollow case 90, the catch assembly 104 is reengaged with pin recess 111, thus locking the slidable extender 92 to the hollow case 90. In this open position, the arm recess 106 is aligned with case recess 96. The wing member 12A is passed into the case recess 96 and the arm recess 106 simultaneously with the lug 94 being passed between any two contiguous post knobs or wire stops 14. When the lowermost of the two contiguous wire stops 14 is aligned or registered with the lug recess 108, the hollow structure 90, connected to the slidable extender 92, is moved and slid downwardly along the wing member 12A to cause the lowermost wire stop 14 to pass into the lug recess 108. For releasing the wire stop 14 from within the lug recess 108, the procedure is reversed.

Figure 33:
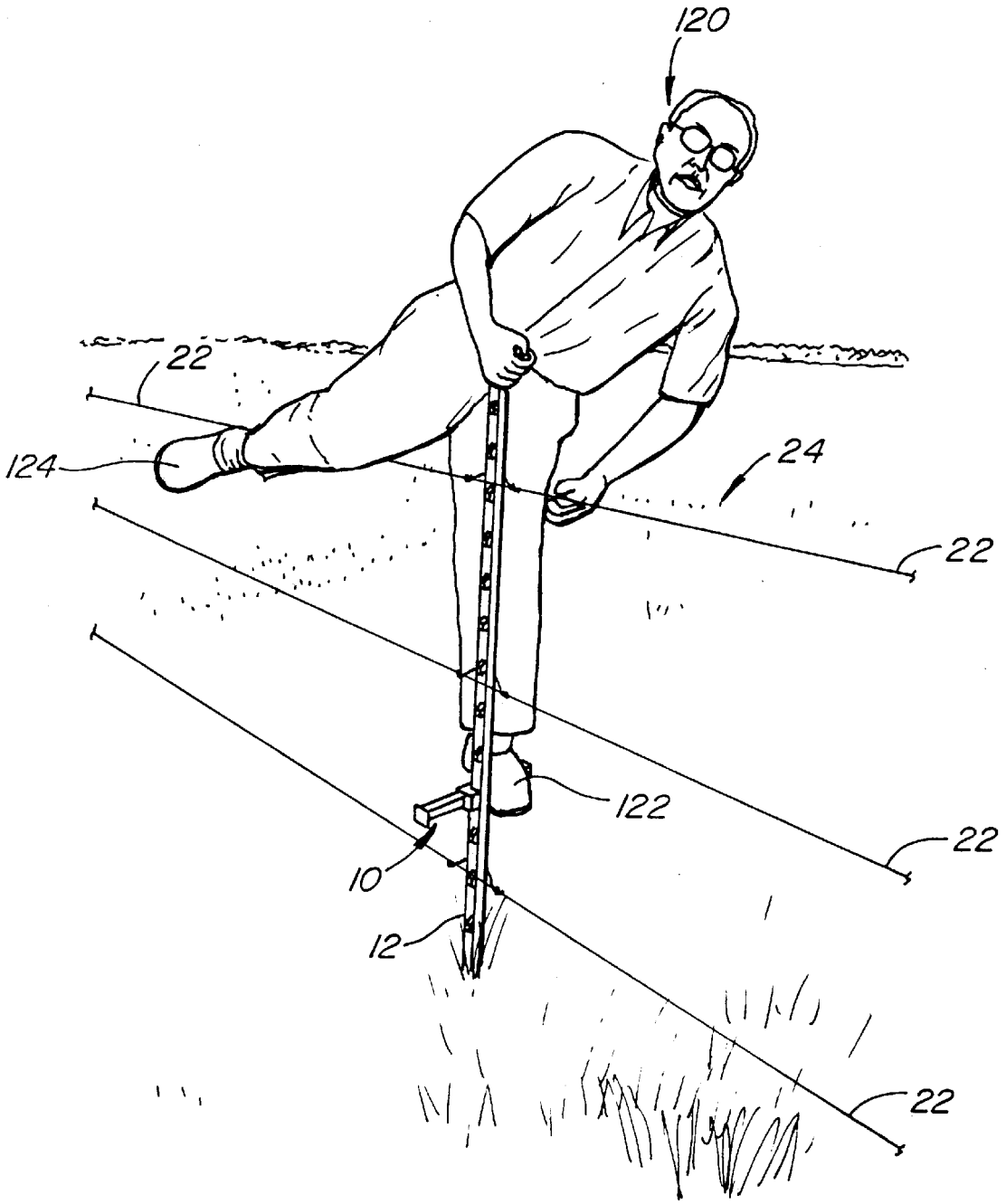
FIG. 33 is a perspective view of the embodiment of the invention depicted in FIG. 1 with a person or user employing the invention to climb over a wire fence.

Continuing to refer to FIG. 33 for operation of the invention and the method for climbing over a fence 24 (e.g., a barb wired fence or any type of fence holding any type of wire including chicken wire, etc.), there is seen a user 120 operating the step member 10. As discussed above, the step member 10 is detachably connected to the post 12. The user 120 places a first foot 122 on the step member 10. Supporting the first foot 122 on the step member 10, a second foot 124 is swung over the highest wire 22 and placed on the step member 10. Supporting the second foot 124 on the step member 10, the first foot 122 is removed and swung over the highest wire 22. The user 120, as a result, steps or climbs over the fence 24.

Thus, while the present invention has been described herein with reference to particular embodiments thereof, a latitude of modification, various changes and substitutions are intended in the foregoing disclosure, and it will be appreciated that in some instances some features of the invention will be employed without a corresponding use of other features without department from the scope of the invention as set forth.

I claim:

1. An apparatus for releasably engaging a fence post comprising a step member including a step body having a first end, a second end, a body sidewall and a structure defining a body recess; extending into said body sidewall for receiving said fence post a lug member integrally bound to said step body sidewall and extending laterally, outwardly therefrom and adjacent to the body recess and having a lug bottom, a lug sidewall, and a lug recess forming a sidewall opening in said lug sidewall and a bottom opening in said lug bottom, said sidewall opening of said lug recess faces said first end of said step body.

2. The apparatus of claim 1 wherein, and said lug recess having a first recess sidewall generally parallel to said body sidewall.

3. The apparatus of claim 2 wherein said lug recess additionally includes a second recess sidewall opposed to said first recess sidewall and generally parallel to said first recess sidewall.

4. The apparatus of claim 1 wherein said structure of said step body further defines a generally hollow step body with said second end having and end opening; a body extender slidably passing through said end opening and into said hollow step body; and a catch assembly secured to said step body for releasably engaging said body extender.

5. The apparatus of claim 3 wherein said structure of said step body further defines a generally hollow step body with said second end having and end opening; a body extender slidably passing through said end opening and into said hollow step body; and a catch assembly secured to said step body for releasably engaging said body extender.

6. The apparatus of claim 4 wherein said step body has a body opening wherein said catch assembly slidably passes; and said body extender includes a first pin recess, a second pin recess, and an extender recess; said second pin recess being aligned with said body opening when said body extender is in a first position with respect to said step body such that part of said catch assembly passes through said body opening and into said second pin recess for locking said body extender into said first position with respect to said step body; and said first pin recess and said extender recess respectively being aligned with said body opening and said body recess when said body extender is in a second position with respect to said step body such that part of said catch assembly passes through said body opening and into said first pin recess for locking said body extender into said second position with respect to said step body.

7. The apparatus of claim 5 wherein said step body has a body opening wherein said catch assembly slidably passes; and said body extender includes a first pin recess, a second pin recess, and an extender recess; said second pin recess being aligned with said body opening when said body extender is in a first position with respect to said step body such that part of said catch assembly passes through said body opening and into said second pin recess for locking said body extender into said first position with respect to said step body; and said first pin recess and said extender recess respectively being aligned with said body opening and said body recess when said body extender is in a second position with respect to said step body such that part of said catch assembly passes through said body opening and into said first pin recess for locking said body extender into said second position with respect to said step body.

8. The apparatus of claim 7 wherein said body extender additionally comprises a flange member connected thereto.

9. A step assembly comprising a post; a post knob integrally bound to the post; a step member releasably secured to the post and including a step body having a first end, a second end, and a structure defining a body recess wherein part of said post removably lodges; a lug member integrally bound to said step body and having a lug bottom, a lug sidewall, and a lug recess forming a sidewall opening in said lug sidewall and a bottom opening in said lug bottom and wherein said post knob removably lodges.

10. The step assembly of claim 9 wherein said lug member extends outwardly from said step body, and said sidewall opening of said lug recess faces said first end of said step body.

11. The step assembly of claim 10 wherein said step body comprises a body base and a body sidewall bound to said body base and having said lug member integrally bound thereto and extending outwardly therefrom, and said lug recess having a first recess sidewall generally parallel to said body sidewall.

12. The step assembly of claim 11 wherein said lug recess additionally includes a second recess sidewall opposed to said first recess sidewall and generally parallel to said first recess sidewall.

13. The step assembly of claim 12 wherein said structure of said step body further defines a generally hollow step body with said second end having and end opening; a body extender slidably passing through said end opening and into said hollow step body; and a catch assembly secured to said step body for releasably engaging said body extender.

14. The step assembly of claim 13 wherein said step body has a body opening wherein said catch assembly slidably passes; and said body extender includes a first pin recess, a second pin recess, and an extender recess; said second pin recess being aligned with said body opening when said body extender is in a first position with respect to said step body such that part of said catch assembly passes through said body opening and into said second pin recess for locking said body extender into said first position with respect to said step body; and said first pin recess and said extender recess respectively being aligned with said body opening and said body recess when said body extender is in a second position with respect to said step body such that part of said catch assembly passes through said body opening and into said first pin recess for locking said body extender into said second position with respect to said step body.

15. The step assembly of claim 9 wherein said post comprises a generally T-shaped structure in horizontal cross-section defined by a first wing section and a second wing section bound to said first wing section and having said post knob integrally bound thereto, said second wing section being partly removably lodged in said body recess.

16. The step assembly of claim 14 wherein said post comprises a generally T-shaped structure in horizontal cross-section defined by a first wing section and a second wing section bound to said first wing section and having said post knob integrally bound thereto, said second wing section being partly removably lodged in said body recess.

17. The step assembly of claim 15 additionally including a wire member supported by said post, and said post knob includes a wire-stop member.

18. The step assembly of claim 16 additionally including a wire member supported by said post, and said post knob includes a wire-stop member.

19. The step assembly of claim 15 additionally including at least one wire member supported by said post and a plurality of wire stop members integrally bound to said second wing section for preventing said at least one wire member from sliding down said post.

20. The step assembly of claim 19 wherein said at least one wire member comprises barb wire.

* * * * *